US010648148B2

(12) United States Patent
Dyer

(10) Patent No.: US 10,648,148 B2
(45) Date of Patent: May 12, 2020

(54) SHEET FOR USE IN GROUND WORKS

(71) Applicant: Timothy Dyer, Northamptonshire (GB)

(72) Inventor: Timothy Dyer, Northamptonshire (GB)

( * ) Notice: Subject to any disclaimer, the term of this patent is extended or adjusted under 35 U.S.C. 154(b) by 0 days.

(21) Appl. No.: 15/765,605

(22) PCT Filed: Oct. 6, 2016

(86) PCT No.: PCT/GB2016/053119
§ 371 (c)(1),
(2) Date: Apr. 3, 2018

(87) PCT Pub. No.: WO2017/060715
PCT Pub. Date: Apr. 13, 2017

(65) Prior Publication Data

US 2019/0078286 A1 Mar. 14, 2019

(30) Foreign Application Priority Data

Oct. 6, 2015 (GB) ..... 1517660.5

(51) Int. Cl.

| | |
|---|---|
| ***E01C 5/20*** | (2006.01) |
| ***E02D 17/20*** | (2006.01) |
| ***E02D 31/02*** | (2006.01) |
| ***E01C 3/00*** | (2006.01) |

(52) U.S. Cl.
CPC ..... *E02D 17/202* (2013.01); *E01C 3/006* (2013.01); *E01C 5/20* (2013.01); *E02D 31/025* (2013.01); *E01C 2201/20* (2013.01); *E02D 2600/20* (2013.01)

(58) Field of Classification Search
CPC ..... E01C 5/20; E01C 13/02; E01C 13/045; E01C 3/006; E02B 11/00
USPC ..... 405/43, 45, 302.4–302.7; 404/34–42, 404/44–45, 27–31
See application file for complete search history.

(56) References Cited

U.S. PATENT DOCUMENTS 5,030,343 A * 7/1991 Urriola ..... E01F 5/00 210/170.03
8,696,241 B2 * 4/2014 Lee ..... E01C 13/083 405/39

FOREIGN PATENT DOCUMENTS

DE 102006052286 A1 2/2008

* cited by examiner

*Primary Examiner* — Sunil Singh
(74) *Attorney, Agent, or Firm* — The Ollila Law Group LLC

(57) ABSTRACT

A sheet for use in ground works, the sheet having an upper face with an plurality of openings therein, a lower face configured so as to permit liquid to drain through the sheet and a spacing arrangement to separate the upper face from the lower face and define a volume therebetween, where the volume is capable of receiving an infill material via the openings in the upper face. The lower face of the sheet is configured to be interengageably secured to an upper face of a similar further sheet.

16 Claims, 9 Drawing Sheets

SHEET FOR USE IN GROUND WORKS

FIELD OF THE INVENTION

The present invention relates to a sheet for use in ground works.

BACKGROUND OF THE INVENTION

Typically, preparing the ground and laying foundations for groundworks requires an upper surface of an area of ground to be cleared of plants and rubble, digging a hole of a required size, and then infilling this hole with different infill materials such as a hardcore, ballast, gravel and sand before overlaying the uppermost layer with one or more of paving slabs, tiles, bricks or a fluid material e.g. concrete. If desired such a fluid material may, before or after it is allowed to solidify, be overlaid with paving slabs, or blocks.

A problem with the current method of preparing ground for groundworks is that a construction worker must dig a hole of substantial depth into the subsoil, e.g. 150-200 mm so as to accommodate the hardcore ballast as well as the required amount of infill material and/or concrete overlay to achieve the desired strength of foundation. Also, the depth of the hole must generally be maintained throughout the dug area, which can be difficult for large areas. If a large area is to be prepared, a substantial volume of earth must be dug and removed. Additionally, when a hole is lined with a liner and a hardcore ballast material, the drainage ability of the finished ground work is diminished, which may become an issue in certain situations.

The current invention aims to overcome or at least mitigate one or more of the problems associated with the prior art.

SUMMARY OF THE INVENTION

A first aspect of the invention provides for a sheet for use in ground works, the sheet comprising: an upper face having an plurality of upper face openings therein; a lower face, wherein the upper face and the lower face are configured so as to permit liquid to drain through the sheet; and a spacing arrangement to separate the upper face from the lower face and define a volume therebetween, the volume capable of receiving an infill material via the upper face openings, wherein the lower face is configured to be interengageably secured to an upper face of a similar further sheet.

Advantageously, the volume defined between the upper and lower faces enable liquid to flow into the volume below the upper face and through the sheet, preventing water from pooling over the sheet. Furthermore, enabling a first sheet to be stacked on to a further similar sheet enables the lower sheet to be used to take the place of a typical 'hardcore' base required for ground works and the upper sheet can be provided to receive the infill material, such as sand or concrete.

Advantageously, the present invention provides for a sheet for use in ground works that is able to receive and retain infill materials and is also adapted for side-to-side and vertical connection to one or more further sheets to form a composite structure foundation.

The vertical stacking of the sheet of the present invention enables a first lower sheet to be used in place of a standard hardcore ballast material which reduces the depth of the hole that needs to be dug for a given groundwork.

Additionally, the sheet of the present invention reduces the amount of infill material required as the structure of the sheet provides support for the infill material and/or concrete fill, which increases the strength thereof and thus requires a thinner amount of material to achieve the same result.

Preferably the upper face defines a substantially plane surface. The substantially plane surface may be defined by a regular repeating array of interconnected panels, with the upper face openings therebetween.

Preferably the upper face of the sheet defines a planar surface with openings therein, and the panels are co-planar with said planar surface. The panels may define at least 50% of the upper face of the sheet.

Each upper face opening may define an open top box structure, which is embedded into the sheet.

Preferably, each open top box structure comprises a base panel. The base panels may be interconnected to substantially define the lower face of the sheet.

Each base panel may comprise an engagement feature so as to releasably secure the lower face of the sheet to the upper face of a further similar sheet.

The engagement feature may be a protrusion extending away from the base panel, in a direction substantially away from the upper face of the sheet.

The engagement feature may be configured to engage an upper face opening of a further similar sheet.

The spacing arrangement may comprise a plurality of side walls extending between the upper face and the lower face. Advantageously, the walls of the recesses provide a large number of supporting walls providing a stronger base for ground works.

Preferably the side walls are provided around each of the upper face openings.

Two of the side walls associated with each opening may comprise an aperture therein. Advantageously, this enables water piping, electrical cables etc to be run through the sheet which can be accessed easily.

Preferably the lower face comprises an engagement feature so as to releasably secure the lower face of the sheet to the upper face of a further similar sheet. Advantageously, this provides a simple method of securing one sheet to another by attaching the bottom of one recess to the top (i.e. the walls) of a further sheet.

Preferably the engagement feature comprises a protrusion extending from the lower face, substantially away from the upper face. More preferably, the protrusions further comprise drainage apertures. Advantageously, as well as being the engagement means, these protrusions also provide grip for the sheet to provide a solid base when placing the sheet onto something such as the ground or a wall.

The engagement feature may be configured to engage the opening of the upper face.

Preferably the lower face comprises a plurality of apertures (drainage apertures) to permit liquid to drain through the sheet.

The upper face may also comprise a plurality of perforations. These perforations may be provided on the upper face panels. Advantageously, this enables drainage to occur through the upper face panels of the sheet and not just the bottom. Furthermore, this would negate the need for a mesh coating to be fitted over the sheet during the construction of a wall and provides locations for securing other components thereto via a fastener.

Preferably each perforation is approximately 2 mm to 20 mm in diameter.

The sheet may further include a mounting arrangement for connecting the sheet with a further similar sheet in a side-by-side configuration. Such a mounting arrangement may be provided on a perimeter wall of the sheet. Advantageously, this removes the need for separate connectors which could get lost during construction. The interconnection of structures side-by-side enables a structure to be formed that will cover the required area.

Preferably the mounting arrangement interdigitates with a mounting arrangement of a further similar sheet.

The perimeter wall may also include apertures therein. Advantageously, this enables cables and piping to extend through the sheet.

The lower face of the sheet may be configured to be interengageably secured to an upper face of a similar further sheet in an offset relationship thereto. Advantageously, this enables the sheet to be used to provide a foundation for a structure which extends over a ledge, for example, a balcony or a bridge.

Preferably the upper face openings are provided in a regular repeating array on the upper face.

Preferably the lower face is provided with a plurality of lower face openings.

Preferably the lower face openings are provided in a regular repeating array on the lower face. Advantageously, these volumes ensure that there are regions of the sheet that are not filled with infill so that air may flow within the sheet.

Preferably the upper face openings and lower face openings are offset.

Preferably over 70% of the volume defined between the upper face and the lower face is a void, preferably more that 80%, more preferably more that 85%.

Preferably the sheet is substantially cuboid. More preferably the sheet is rigid.

The sheet may be formed from a plastics material, e.g. polyethylene, polypropylene or ABS.

Preferably the upper face is substantially planar. Advantageously, this provides a planar face on which to build on to.

A second aspect of the invention provides for a composite foundation structure comprising; a first sheet according to any preceding claim; a second sheet according to any preceding claim, wherein the lower face of the first sheet is interengageably secured to the upper face the second sheet.

The first sheet may be positioned to be offset from the second sheet.

The composite foundation structure may also include a third sheet, which is connected to the first sheet of the second sheet in a side by side connection. The third sheet may be offset from the second sheet.

A third aspect of the invention provides for a method of creating a paved area using a plurality of sheets, each sheet comprising an upper face having an plurality of upper face openings therein, a lower face configured so as to permit liquid to drain through the sheet, a spacing arrangement to separate the upper face from the lower face and define a volume therebetween, the volume capable of receiving an infill material via the upper face openings, the lower face being configured to be interengageably secured to an upper face of a similar further sheet, the method comprising the steps of: connecting a plurality of the sheets in a side-by-side configuration so as to form a lower composite structure; connecting a plurality of the sheets in a side-by-side configuration so as to form an upper composite structure; securing the lower face of the upper composite structure to the upper face of the lower composite structure; filling the plurality of sheets of the upper composite structure with an infill material; and laying one more paving elements over the layer of infill material.

A fourth aspect of the invention provides for a method of creating a wall using a sheet, the sheet comprising the sheet comprising an upper face having an plurality of upper face openings therein, a lower face configured so as to permit liquid to drain through the sheet, a spacing arrangement to separate the upper face from the lower face and define a volume therebetween, the volume capable of receiving an infill material via the upper face openings, the lower face being having a plurality of engagement features to interengageably secured to an upper face of a similar further sheet, the method comprising the steps of: securing a breathable membrane to a partition wall frame for substantially covering the partition wall in said breathable membrane; securing thermal insulation over the breathable membrane for substantially covering the breathable membrane in said thermal insulation; connecting a plurality of the sheets in a side-by-side configuration so as to form a composite structure; providing the composite structure over the thermal insulation; and securing the plurality of sheets to the thermal insulation.

Preferably the method may also include the step of providing a mesh coating to the upper face of the sheets.

Preferably the upper face comprises a plurality of perforations. Advantageously, you don't require a separate mesh.

A fifth aspect of the invention provides for a method of creating a field using a plurality of sheets, the sheets comprising the sheet comprising an upper face having an plurality of upper face openings therein, a lower face configured so as to permit liquid to drain through the sheet, a spacing arrangement to separate the upper face from the lower face and define a volume therebetween, the volume capable of receiving an infill material via the upper face openings, the lower face being configured to be interengageably secured to an upper face of a similar further sheet, the method comprising the steps of: placing a permeable membrane over excavated ground; connecting a plurality of the sheets in a side-by-side configuration so as to form a composite structure; filling the plurality of sheet with an infill material to substantially cover the plurality of sheets; and laying a layer of soil over the infill material to substantially cover said infill material.

Preferably the permeable membrane is a geotextile.

Preferably the infill material is sand.

BRIEF DESCRIPTION OF THE DRAWINGS

Embodiments of the invention will now be described with reference to the accompanying drawings, in which.

DETAILED DESCRIPTION OF EMBODIMENT(S)

Figure 1:
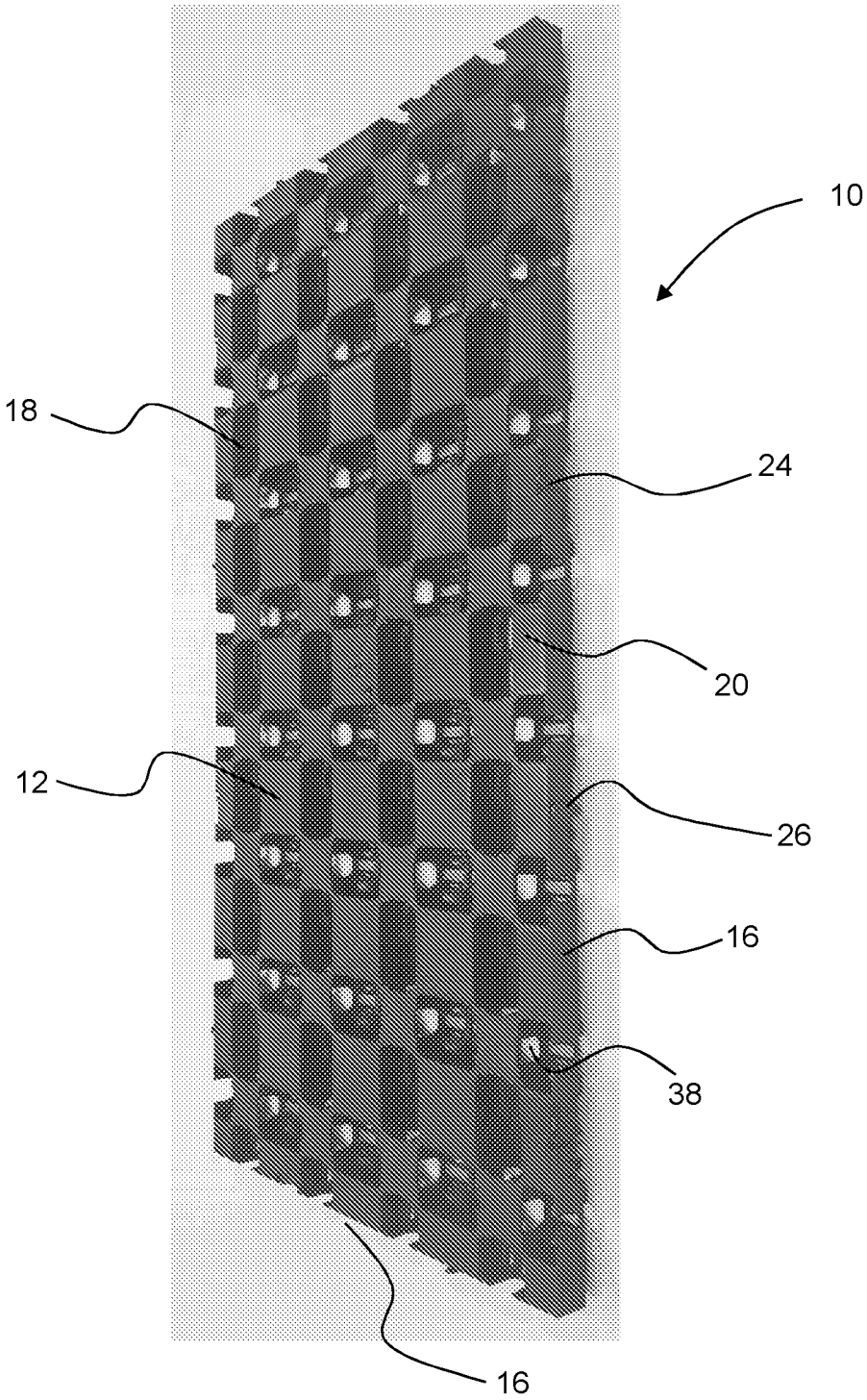
FIG. 1 shows a perspective view of the upper face of a sheet according to the present invention.
Figure 2:
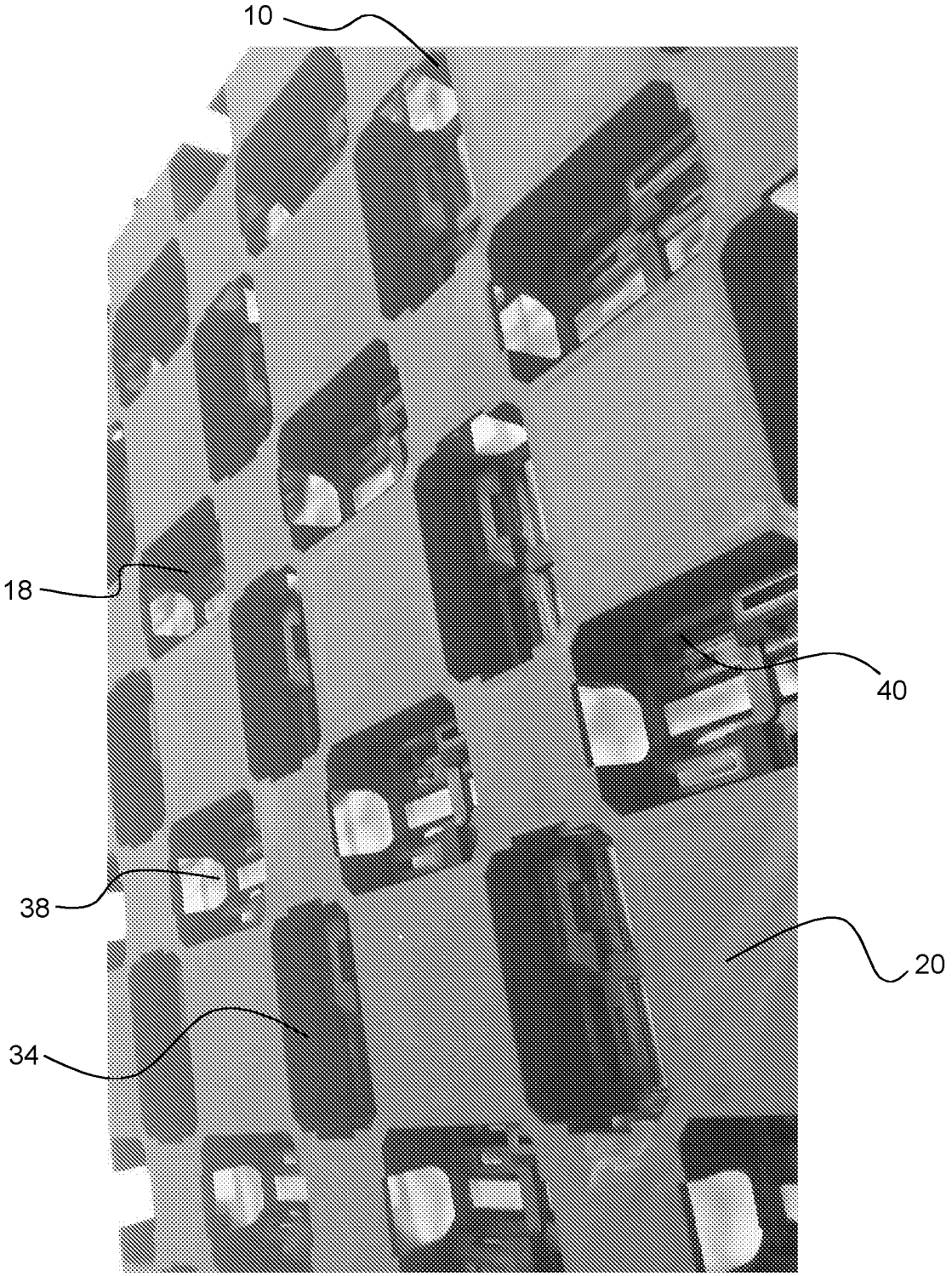
FIG. 2 shows an enlarged view of the upper face of the sheet of FIG. 1.

Referring to FIGS. 1 to 5, a sheet for use in ground works according to an embodiment of the present invention is indicated generally at 10. The sheet 10 is also referred to as a foundation sheet or a foundation tray. The sheet 10 has an upper face 12 and a lower face 14 and a perimeter wall 16 extending therearound.

The sheet 10 is formed from a rigid material, such as a plastics material, e.g. polyethylene, polypropylene or ABS. However, in alternative embodiments, the sheet 10 may be formed form different materials and/or may not be completely rigid. In the illustrated embodiment, the sheet 10 is provided in the form of a cuboid but it will appreciate that any other suitable shape may be used.

The perimeter wall 16 is provided with a mounting arrangement 22 for connecting the sheet 10 with a further similar sheet in a side-by-side configuration (as discussed later with reference to FIGS. 6 and 7). In the illustrated embodiment, the mounting arrangement 22 is provided on the perimeter wall 16 but it will appreciated that the mounting arrangement 22 may be provided a separate component to the sheet 10.

Figure 3:
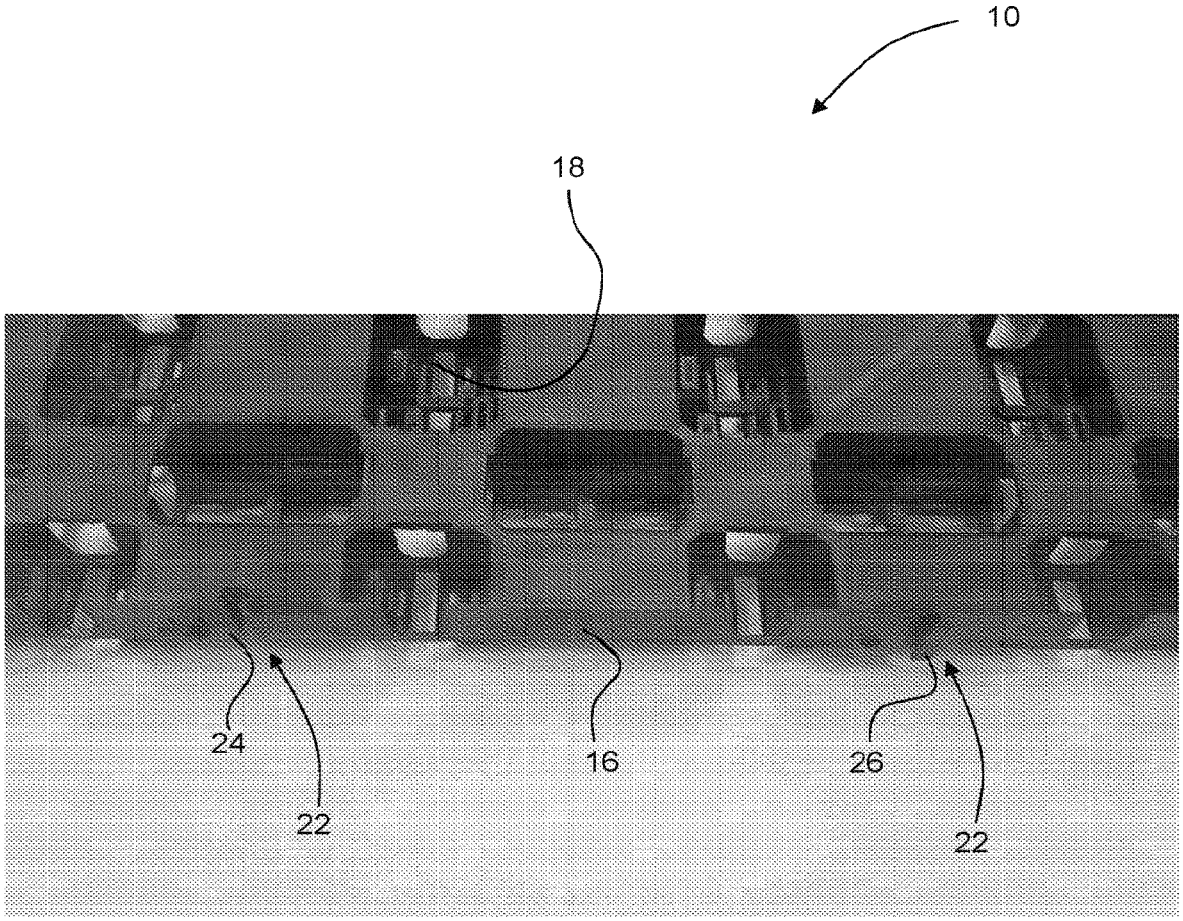
FIG. 3 shows an enlarged view of an edge of an upper face of the sheet of FIG. 1.

The mounting arrangement 22, as illustrated most clearly in FIG. 3, is provided in the form of alternating recesses 24 and protrusions 26 which extend substantially perpendicularly from the perimeter wall 16. The recesses 24 and protrusion 26 are spaced around the perimeter wall 16 which are able to interdigitate with a corresponding recess 24 or protrusion 26 of a further sheet 10.

The upper face 12 is provided with a series of upper face openings 18 therein, which may also be referred to as an access opening or an access panel as they enable a user to access the lower face 14 of the sheet 10, and things such as piping, and cables, therethrough.

The upper face openings 18 are provided on the upper face 12 in a regular repeating array. In the illustrated embodiment, the openings 18 are provided in the form of rectangular openings, which are arranged parallel and perpendicular to the longitudinal axis of the sheet 10.

The upper face 12 is substantially defined by a series of upper panels 20, where the openings 18 are provided in an alternating pattern with said panels 20. The panels 20 are substantially planar which provide a substantially planar upper face 12 of the sheet 10.

Figure 4:
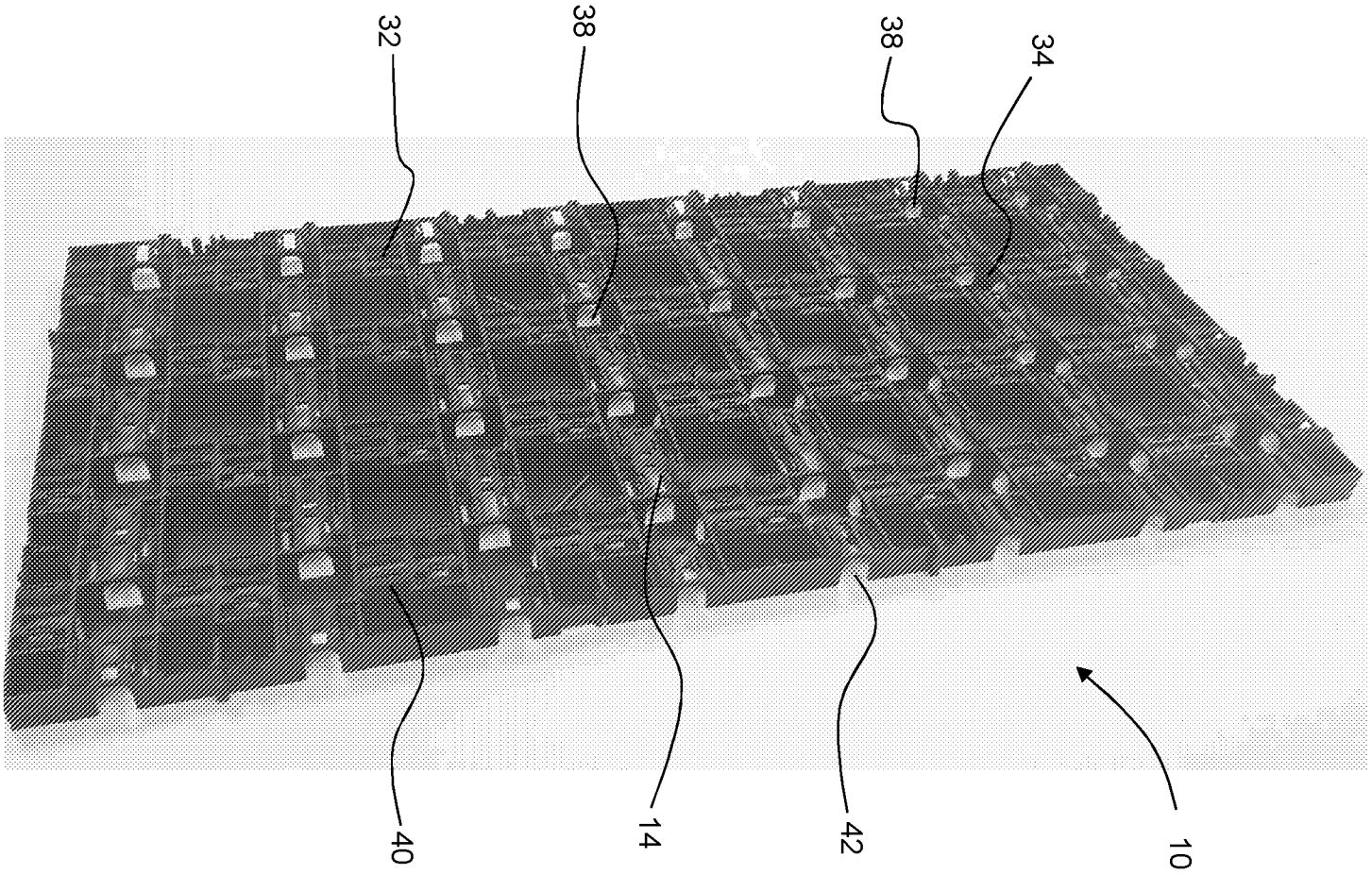
FIG. 4 shows a perspective view of the lower face of the sheet of FIG. 1.
Figure 5:
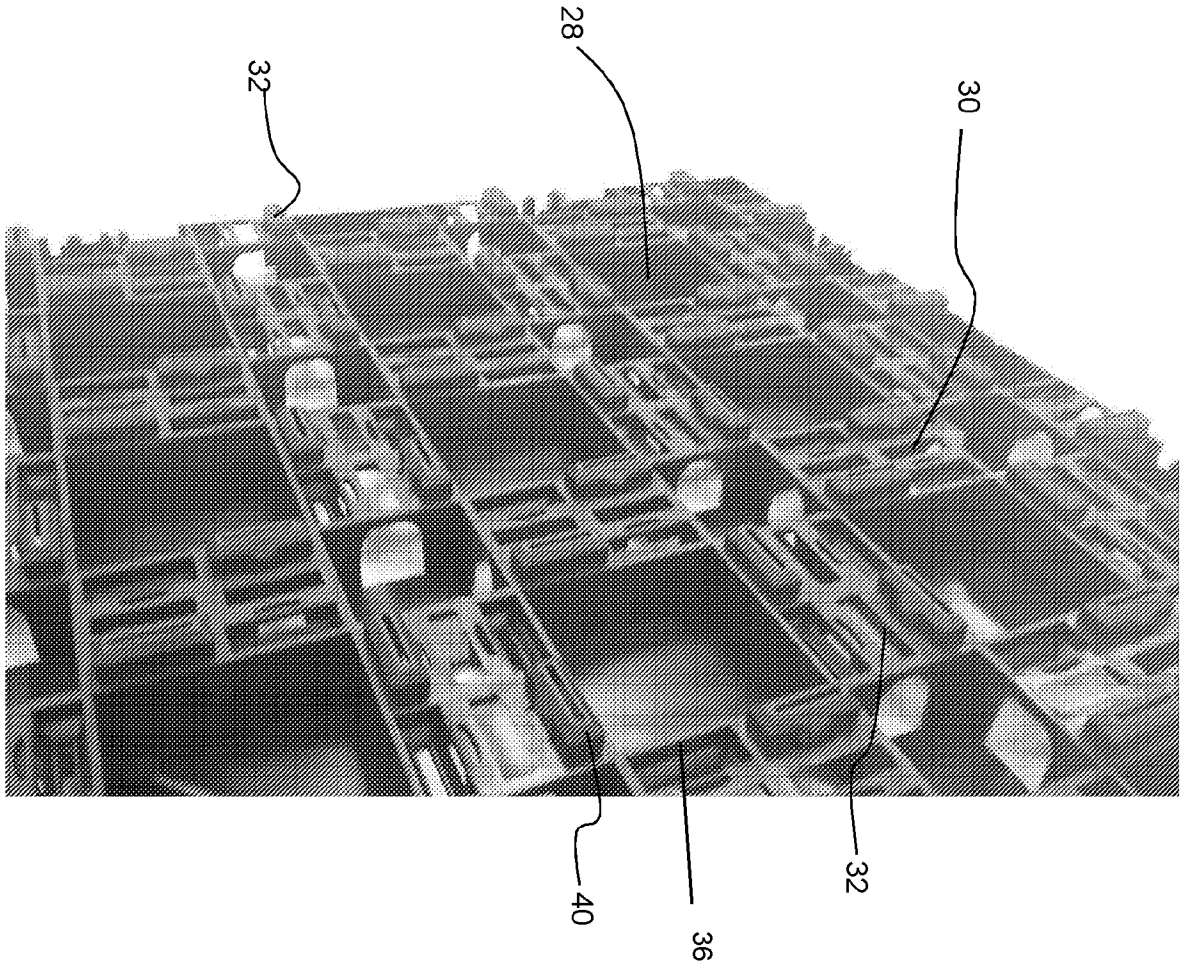
FIG. 5 shows an enlarged view of the lower face of FIG. 4.

Referring to FIG. 4, the lower face is provided with a series of lower face openings 28 in a regular repeating array. In the illustrated embodiment, the openings 28 are provided in the form of square openings.

The lower face 14 is substantially defined by a series of lower panels 30, where the openings 28 are provided in an alternating pattern with said panels 30. The upper face 12 and lower face 14 are configured to allow a liquid to flow through the sheet so as to be able, in use, to be able to drain away from the upper face of the sheet 10. In the illustrated embodiment, each of the lower panels 30 are provided with a series of apertures 32 to enable a liquid to drain therethrough the sheet. However, it will be appreciated that a single aperture may be provided on the lower panel 30 or that an aperture may not be provided on every lower panel 30.

The upper face opening 18 and lower face opening 28, and likewise the upper panel 20 and the lower panels 30 are offset from each other. The sheet 10 is further provided with a spacing arrangement to separate the upper face from the lower face and define a volume therebetween, the volume capable of receiving an infill material via the upper face openings upper face 12 and lower face 14. The spacing arrangement is provided in the form of a series of upstanding side walls 34 which work to separate the upper face 12 and the lower face 14 and also to provide increased mechanical strength of the sheet 10 as a whole.

In the illustrated embodiment, the volume defined by the upper face 12, lower face 14 and the perimeter wall 16 is only approximately 13% filled with the sheet material (i.e. upper and lower faces, side walls etc) and a void defines approximately 87% of the total volume of the sheet 10. However, in alternative embodiments, it will be appreciated that this ratio may vary, e.g. a void may define >50% of the total volume, >60% of the total volume, >70% of the total volume, >80% of the total volume or >85% of the total volume.

This upper face openings 18 substantially define an open top box structure which is embedded into the sheet 10, and the base panels 36 substantially define the lower face 14 of the sheet. The side walls 34 are associated with the upper face openings 18 and define the side walls of the open top box structures.

In the illustrated embodiment, two of the side walls 34 associated with each upper face opening 18 are provided with an aperture 38 located on opposing side walls 34. These apertures 38 enable cables, piping, or reinforcing bars etc. to be placed through the sheet 10 between the upper face 12 and the lower face 14. In alternative embodiments, the perimeter wall 16 is also provided with a series of apertures 42 which are positioned to substantially align with the aperture 38 which opposes the perimeter wall 16. Although all of the apertures 38, 42 have been illustrated as being positioned on opposing side walls 16, 34, it will be appreciated that the apertures may be provided on adjacent walls so as to define a corner. The apertures 38 in the side walls 34 also act as a drainage feature of the system, and would allow liquid to drain through the sheet 10 even if there were no additional drainage apertures in the lower face 14.

The lower face 14 is further provided with an engagement feature 40 so as to be able to be interengageably secured to an upper face 12 of a similar further sheet 10. More specifically, an engagement feature 40 is provided on each of the lower face panels 30. However, it will be appreciated that in alternative arrangements an engagement feature 40 may not be provided on every lower face panel 30. In the illustrated embodiment, the engagement feature 40 is provided in the form of two protrusions which extend substantially perpendicularly from the lower face 14, in a direction substantially away from the upper face 12.

Figure 8:
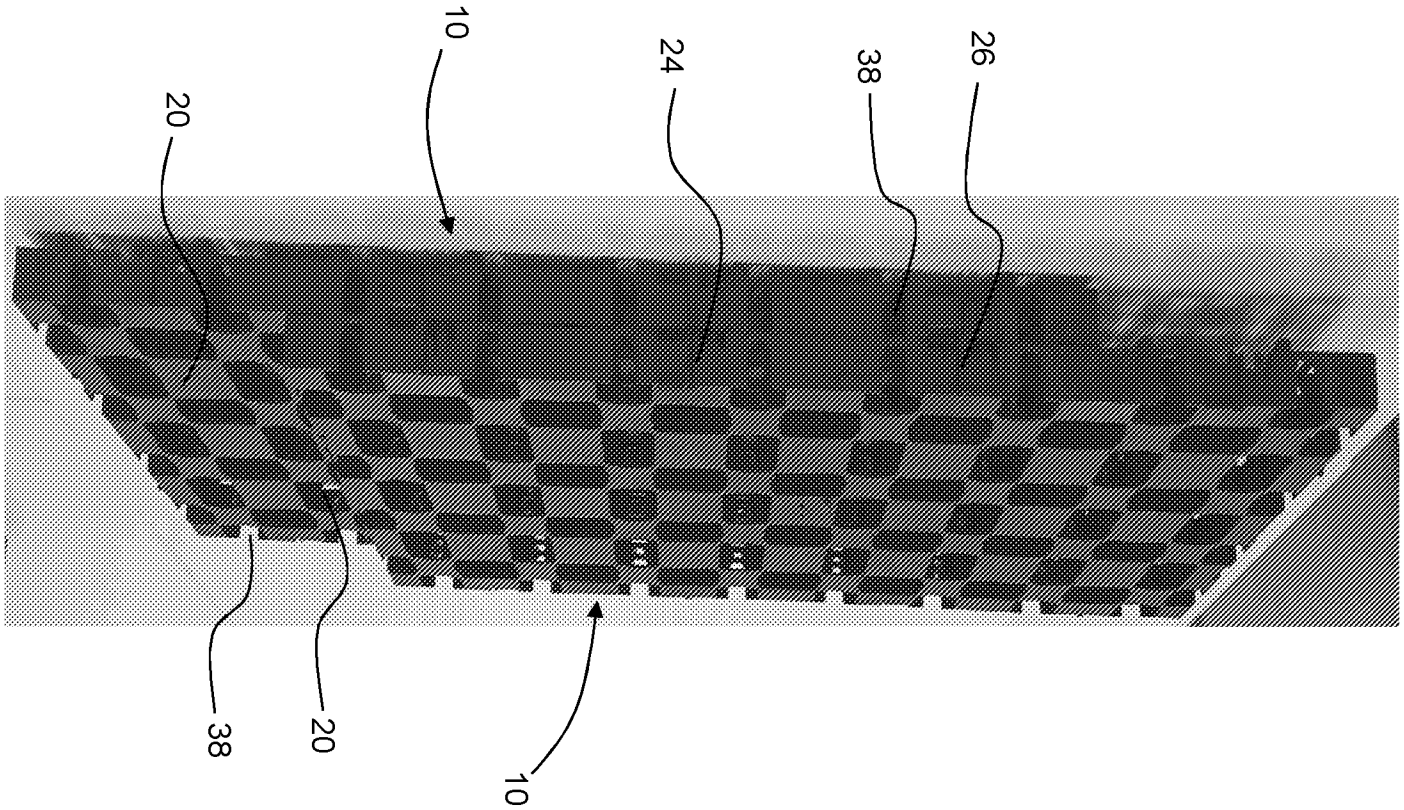
FIG. 8 shows a composite foundation structure including the sheet of FIG. 1 secured to a subjacent further sheet in an offset configuration.
Figure 9:
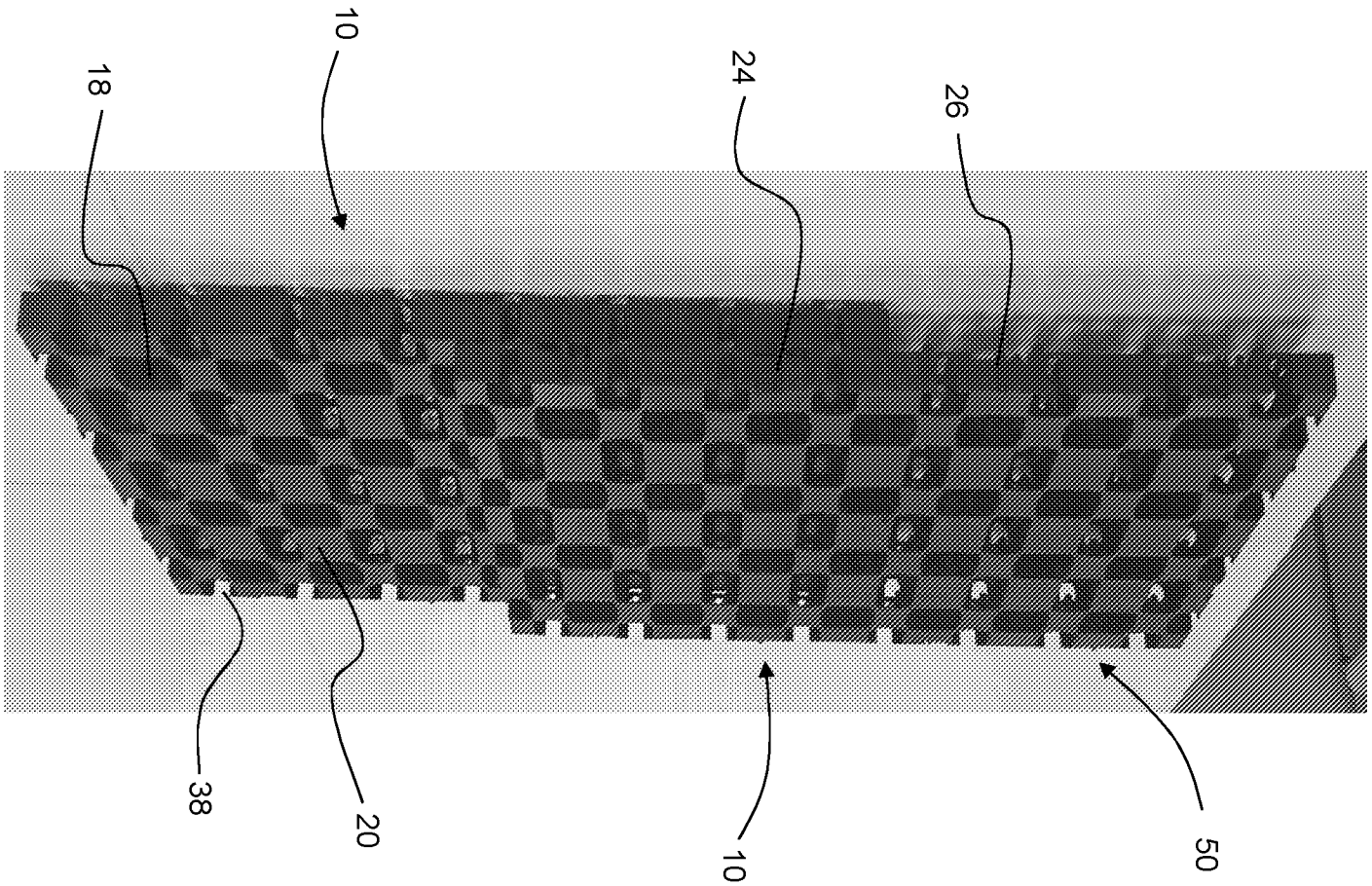
FIG. 9 shows a composite foundation structure including the sheet of FIG. 1 secured to a subjacent further sheet in an offset configuration.

The protrusions 40 have a tapered end so as to improve the ease of assembly of the sheet 10 with a further similar sheet. The protrusions 40 also include an aperture extending therethrough so as to further aid in drainage of the sheet 10. The protrusions 40, provided in the form of teeth projecting from the side of the sheet, are configured to engage the outer perimeter of the upper face openings 18 so as to engageably secure the sheet 10 to a further sheet, as is illustrated in FIGS. 8 and 9. Accordingly, the upper face opening 18 provide several advantages as they are able to receive an infill material, they provide a drainage means for the sheet 10, they provide an access area for access to piping or cables that are passed through the sheet, as well as providing a locating and engaging surface for the engagement means 40.

Figure 6:
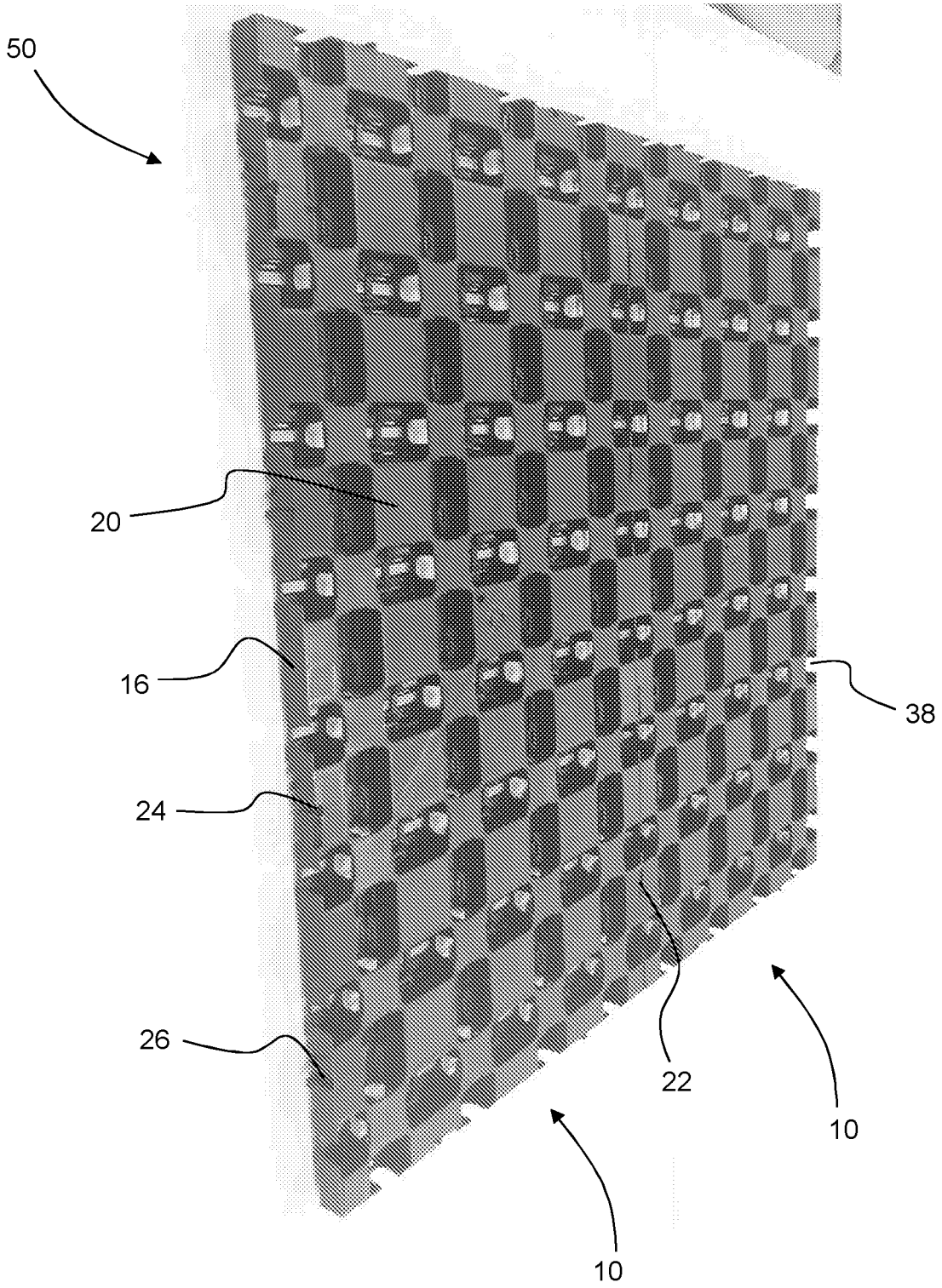
FIG. 6 shows a composite foundation structure including the sheet of FIG. 1 connected in a side-by-side configuration with a further sheet.

Referring to FIGS. 6 to 9, a composite foundation structure comprising two sheets 10 is indicated generally at 50. Referring firstly to FIG. 6, a sheet 10 is illustrated as connected to a further sheet 10 in an aligned side-by-side configuration to form an approximately 1 $m^2$ foundation structure 50. Due to the volume of the assembled structure 50 and the voids defined therein, the structure assembled from two sheets 10 can hold approximately 27 litres of water therein.

Figure 7:
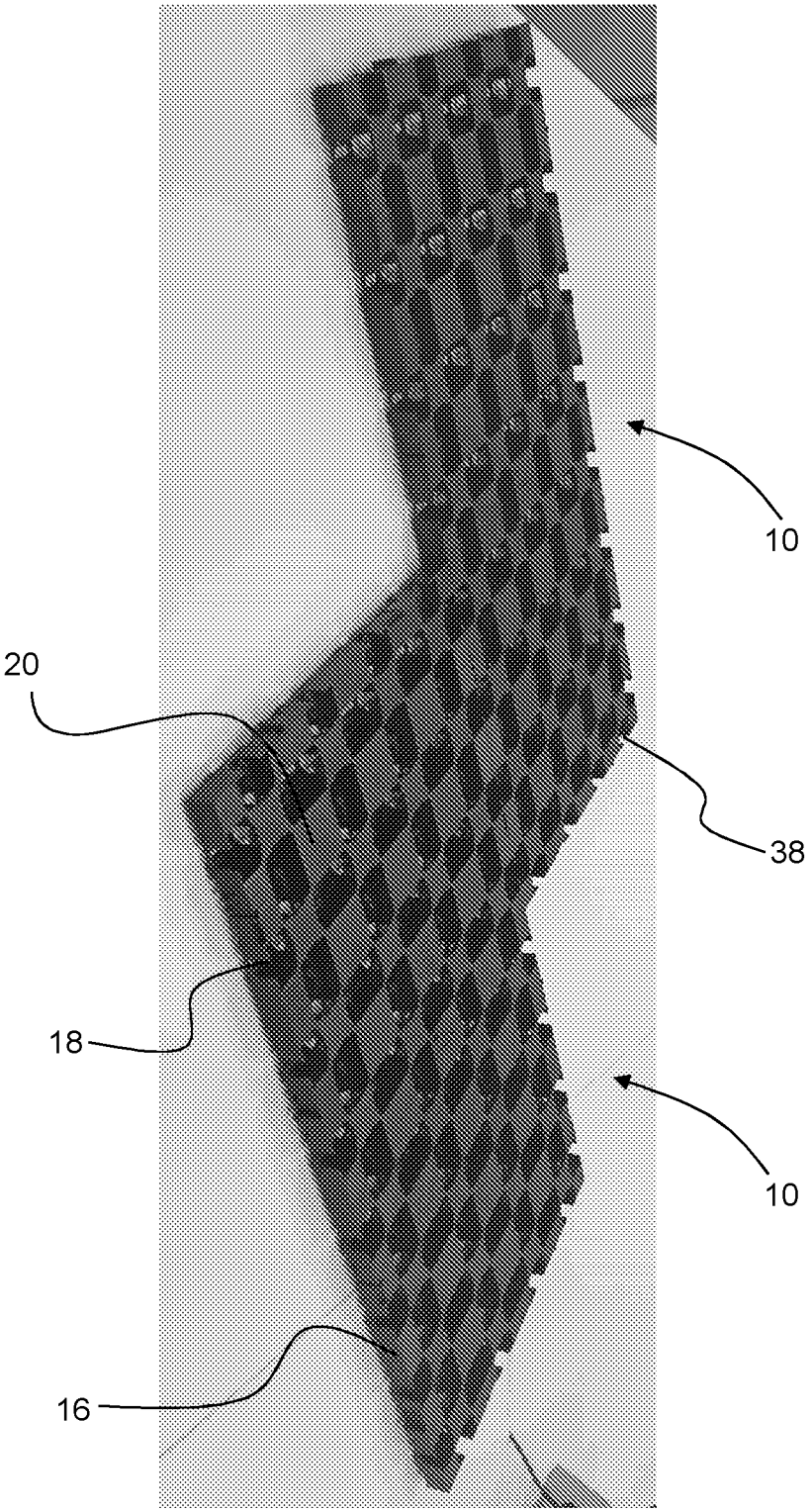
FIG. 7 shows a composite foundation structure including the sheet of FIG. 1 connected in an offset side-by-side configuration with a further sheet.

The sheets 10 can also be connected together in an offset configuration, as is illustrated in FIG. 7 and each pair of sheets 10 are able to be connected together at multiple different positions (i.e. offset by different distances) to suit the application. The sheets 10 are also able to be connected where a first sheet 10 is in a different orientation to a second sheet (i.e. they are arranged perpendicular to each other), as the arrangement of engagement features 40 and the upper face openings 18 are rotationally symmetrical of Order 4 (i.e. about 90°).

Referring to FIGS. 8 and 9, a sheet 10 is illustrated as interengageably secured to a subjacent sheet 10 in an offset configuration to form a composite foundation structure 50. Although not illustrated for clarity, multiple additional sheets 10 may be connected to the existing foundation structure 50 either in a side-by-side configuration or in a stacking arrangement, or both, to suit the application as required.

In use, the sheets 10 as described above may be used to form a paved area. A hole will be required to be dug first so as to provide a place to receive the composite foundation structure for the paved area. A first row of sheets 10 will be connected together so as to define the required area, and a second layer of sheets 10 will be secured thereto. The engagement features 40 of the lower face 14 will work to engage the base soil so as to frictionally hold the composite structure in place, both during construction and afterwards. The upper face panels 20 provide a planar upper surface for the construction process, which prevent, or minimises the risk of, uneven paving units being layed thereon. The upper face openings 18 of the upper row of sheets 10 are able to receive an infill material, such as sand. This sand layer may then be covered with a liquid, such as cement, on which one or more paving elements may be layed. The lower row of sheets replaces the typically used hardcore ballast material layer.

The sheets 10 as described above may also be used to produce a wall, such as a stud wall. The frame is first covered in a breathable membrane which will be secured thereto and thermal insulation is then secured to substantially cover the breathable membrane. A first row of sheets 10 is then connected together so as to define the required area, which will then be secured to the frame of the partition wall. The composite structure 50 is structured to the wall by the use of fasteners which are placed through the apertures present in the lower face, more specifically the lower face panel of the sheet. The engagement features 40 of the lower face which extend from the lower face substantially away from the upper face, abuts the breathable membrane and depresses said membrane so as to engage the composite structure and frictionally hold the composite structure in place, both during construction and afterwards. The volume defined between the upper face and lower face of the sheet provides an air space which will further increase the thermal insulation of the wall. A mesh may then further be placed over the sheets so as to provide a surface with enough grip for coating with a plaster, or similar, material so as to finish the wall. In alternative embodiments, the upper face panels may be provided with a series of apertures which would provide the sheet with enough grip and so remove the need for a separate mesh coating.

The sheets 10 as described above may also be used to produce a field, such as a playing field for sports events. A hole is dug first so as to provide a place to receive the composite foundation structure for the paved area. A permeable membrane, such as a geotextile, is then placed over the excavated ground. A first row of sheets 10 is connected together so as to define the required area, and a second layer of sheets 10 is secured thereto. The engagement features 40 of the lower face 14 works to engage the base soil so as to frictionally hold the composite structure in place, both during construction and afterwards. The upper face panels 20 provide a planar upper surface for the construction process. The upper face openings 18 of the upper row of sheets 10 are able to receive an infill material, such as sand. This sand layer may then be covered with a top soil material so as to produce the field. Due to the large amount of internal volume of the sheets that are able to receive liquid, and the drainage ability of the composite structure, the resulting field benefits from increased drainage performance which minimises the risk of the field becoming waterlogged.

It will be further be appreciated that the ability of the sheets to be layers in an offset configuration enables the sheets to work as a foundation for the production of objects such as a balcony or a bridge, by arranging the sheets to form a composite structure where the sheets are supported from above or below by two adjacent sheets.

Although the invention has been described above with reference to one or more preferred embodiments, it will be appreciated that various changes or modifications may be made without departing from the scope of the invention as defined in the appended claims.

Although all of the sheets have been illustrated as being substantially the same size, it will be appreciated that different sized panels may be used in a single installation. For example different sized sheets may be required at the ends of a structure so as to produce the desired area.

In alternative embodiments, some or all of the upper face panels may be perforated. Such an arrangement provides a surface having improved grip for attaching material thereto and also provides improved drainage of the overall composite structure. The diameter of these perforations may range from approximately 2 mm to 20 mm.

The upper face of the sheet may alternatively be provided as a planar surface without the upper face openings being present. In such embodiments, the upper face may comprise a series of features, such as perforations, serrations, or any other suitable feature that would increase the friction of the upper face and enable a material such as plaster to grip the sheet when placed thereon. It will be appreciated that in such embodiments where the upper face openings are not present, the side walls may still be provided to provide structural support for the sheet.

It will be appreciated that in use, the step of digging the hole may not be required in the use of the sheet of the present invention when forming a field, a paved area of any other use, as the sheet may be provided on the level ground as a floating foundation for ground works.

The invention claimed is:

1. A sheet for use in a composite foundation structure, the sheet comprising:

an upper face defining a substantially planar surface having a plurality of upper face openings therein, the substantially planar surface defined by a regular repeating array of interconnected panels coplanar with the planar surface, with the upper face openings therebetween;

a lower face; and a spacing arrangement to separate the upper face from the lower face and define a volume therebetween, the volume capable of receiving an infill material via the upper face openings; wherein the upper face and the lower face are configured so as to permit liquid to drain through the sheet; and wherein the lower face comprises an engagement feature so as to releasably secure the lower face of the sheet is configured to be interengageably secured to the upper face of a similar further sheet, wherein the panels define at least 50% of the upper face of the sheet.

2. A sheet according to claim 1, wherein the upper face openings are provided in a regular repeating array on the upper face.

3. A sheet according to claim 1, wherein the lower face is provided with a plurality of lower face openings.

4. A sheet according to claim 3, wherein the lower face openings are provided in a regular repeating array on the lower face.

5. A sheet according to claim 3, wherein the upper face openings and lower face openings are offset.

6. A sheet according to claim 1, wherein each upper face opening substantially defines an open top box structure, which is embedded into the sheet.

7. A sheet according to claim 6, wherein each open top box structure comprises a base panel, further wherein the base panels are interconnected to substantially define the lower face of the sheet.

8. A sheet according to claim 7, wherein each base panel comprises the engagement feature so as to releasably secure the lower face of the sheet to the upper face of a further similar sheet.

9. A sheet according to claim 8, wherein the engagement feature comprises a protrusion extending away from the base panel, in a direction substantially away from the upper face of the sheet.

10. A sheet according to claim 1, wherein the lower face of the sheet comprises a plurality of apertures to permit liquid to drain through the sheet.

11. A sheet according to claim 1, comprising a mounting arrangement for connecting the sheet with a further similar sheet in a side-by-side configuration.

12. A sheet according to claim 11, comprising a perimeter wall, wherein the mounting arrangement is provided on said perimeter wall for connecting the sheet with a further similar sheet.

13. A sheet according to claim 1, wherein at least 70% of the volume defined between the upper face and the lower face is a void.

14. A sheet according to claim 1, wherein the lower face of the sheet is configured to be interengageably secured to an upper face of a similar further sheet in an offset relationship thereto.

15. A sheet according to claim 1, wherein an aperture extends through the sheet from opposing side walls and between the upper face and the lower face of the sheet.

16. A composite foundation structure comprising; a first sheet according to claim 1; a second sheet according to claim 1, wherein the lower face of the first sheet is interengageably secured to the upper face the second sheet.

* * * * *